United States Patent [19]

Suominen

[11] 4,174,657

[45] Nov. 20, 1979

[54] METHOD OF FORMING A PLASTIC SHOPPING BAG HAVING A REINFORCED HANDLE

[76] Inventor: Heikki S. Suominen, Petsamonk 14, Tampere, Finland

[21] Appl. No.: 920,613

[22] Filed: Jun. 29, 1978

Related U.S. Application Data

[62] Division of Ser. No. 856,871, Dec. 2, 1977, Pat. No. 4,125,220.

[30] Foreign Application Priority Data

Dec. 3, 1976 [FI] Finland ..... 763481

[51] Int. Cl.[2] ..... B31B 1/14; B31B 1/86

[52] U.S. Cl. ..... 93/35 H; 156/253

[58] Field of Search ..... 93/35 H, 35 R; 156/253, 156/510; 150/1.7, 12; 229/53, DIG. 6

[56] References Cited

U.S. PATENT DOCUMENTS 3,548,723 12/1970 Sengewald ..... 93/35 H

*Primary Examiner*—Robert D. Baldwin

*Attorney, Agent, or Firm*—Pollock, Vande Sande & Priddy

[57] ABSTRACT

A plastic shopping bag is provided with an integral handle portion of wave configuration having a strip of reinforcement material therein of heavier gauge plastic than the remainder of the bag. The heavier gauge strip extends across the handle portion in spaced relation to the side edges of the bag. A plurality of such bags are fabricated by providing a flattened plastic film tube which has coextensive overlapping strips of heavier gauge material on the opposite faces thereof, cutting through the tube faces along a cutting line of cyclically recurring wave configuration that extends in the direction of elongation of the heavier gauge strips, the wavelength of said wave configuration being substantially equal to the desired width of the mouth of one of said shopping bags and the amplitude of said wave configuration being greater than the widths of said heavier gauge strips whereby the crests of the wave configuration are located at positions outside the boundary edges of the heavier gauge strips, and thereafter cutting the two faces along transverse seam lines which extend from the wave configuration crests to the outer edges of the flat tube of plastic film material.

5 Claims, 7 Drawing Figures

METHOD OF FORMING A PLASTIC SHOPPING BAG HAVING A REINFORCED HANDLE

This is a division, of application Ser. No. 856,871, filed Dec. 2, 1977, now U.S. Pat. No. 4,125,220.

BACKGROUND OF THE INVENTION

The present invention relates to plastic shopping bags having integral handle portions, and to a novel method for manufacturing such bags.

Various plastic bag structures, and methods of manufacturing the same, have been suggested heretofore wherein the bags are provided with handles located at the mouth of the bag and having a hole therein to facilitate carrying of the bag or to suspend the bag from a rack or hanger. It has also been suggested heretofore that such bags can be formed by the provision of appropriate longitudinal and transverse seam lines in an elongated length of molded plastic tubing, which seam lines serve to sever individual bags from a length of such tubing; and has additionally been suggested heretofore that selected portions of such a bag, including the handle portion thereof, may be reinforced by gluing reinforcement material onto portions of the bag, or by increasing the gauge of selected portions of the tube, at those regions where it is desired to provide additional strength in the finished bag.

The attachment of separate strips of reinforcement material to a plastic tube, and/or the extrusion of heavier gauge portions in the plastic tube to provide such reinforcement, ordinarily require comparatively complex and expensive machinery, and the resultant bags tend to be comparatively expensive. Moreover, known bag manufacturing techniques which contemplate the provision of such heavier gauge strips of material at portions of the bag have been such that the heavier gauge material ordinarily intersects those portions of the tube wherein the transverse seam lines, or side seams of the bag, are to be formed; and this in turn produces difficulties during the seaming of the bag edges since the transverse seam lines extend across film layers of differing thicknesses.

More particularly, it has been suggested heretofore that plastic shopping bags can be fabricated by providing a comparatively wide plastic film tubing as a starting material, said tubing having a pair of reinforcement strips formed on the opposing sides thereof, e.g., during the extrusion of the plastic tubing. The reinforced portion of the tubing is severed longitudinally by a cutting line of wave configuration which has a wavelength that corresponds to the width of the bag, and individual bags are thereafter cut from the starting tubing by providing transverse seam lines which intersect the wavelike cutting line. In this known method, the wavelike and transverse cutting lines are so located relative to one another and to the reinforcement strip in the bag that the reinforcement extends across the side seams of the bag; and this produces problems during the seaming of the bag edges since, at these locations, differing film thicknesses exist. The thicker plastic film section is not as easily seamable as the thinner sections, which makes it difficult to produce consistent side seams in rapid mass production. Moreover, the thickened region which is provided in the center of the plastic tubing impairs the reeling of such tubing as may be desired in a mass production technique, and makes it difficult to keep the plastic tubing on such reels.

The present invention obviates these disadvantages of the prior art, and provides an improved bag and manufacturing technique which achieves the desired reinforcement in the handle portion of the bag, but which does so in a fashion which significantly reduces the costs of production and of the resulting bags. A bag manufactured according to the present invention permits the side seams to be achieved more quickly than has been possible heretofore since the side seams always occur on film sheet layers of predetermined constant thickness. Moreover, the techniques and resulting bags of the present invention achieve a saving of plastic raw material, a factor which has significance in the large scale production of inexpensive plastic shopping bags.

SUMMARY OF THE INVENTION

In accordance with the present invention, a plurality of plastic shopping bags are fabricated by providing an elongated tube of plastic film material having a flattened configuration which defines a pair of elongated faces that are disposed closely adjacent to one another. Each of the faces includes an elongated strip of plastic material, said strips being adhesively secured to opposite sides of the flattened tube as an initial step in the bag fabricating method or, in the alternative, being preformed in the tube faces during the extrusion of the tube of plastic film material. The tube strips, located respectively on opposite faces of the plastic tube, are disposed in coextensive overlapping relation to one another in the direction of elongation of the tube at locations on the tube faces substantially equidistant from the edges of the tube faces, and the width of each of said strips is substantially less than the width of its associated tube face.

The plastic tube having the aforementioned reinforcement strips thereon is then cut along a cutting line which exhibits a cyclically recurring wave configuration extending in the direction of elongation of the tube faces and along the coextensive overlapping strips. The wavelength of this cutting line wave configuration is substantially equal to the desired width of the mouth of one of the shopping bags. The amplitude of the cutting line wave configuration, moreover, is greater than the widths of the strips of reinforcement material whereby the spaced crests of the cutting line wave configuration cut through the film material of the tube faces at positions which are outside the boundary edges of the strips. A plurality of transverse seam lines are then provided to define the side edges of the several bags, by sealing and cutting through the tube faces along lines which extend respectively between the spaced crests of the cutting line wave configuration and the outer edges of the flattened tube of plastic material. These transverse seam lines terminate at the crests of the wave configuration, and since those crests are located outside of the reinforcement strip, the transverse seams are always formed in overlapping layers of fixed thickness whereby the seaming operation, and the characteristics of the resulting seams, are considerably improved.

The fabricating technique can further include the step of punching a plurality of holes through the tube faces, one for each cycle of the wave configuration, with each of said holes being located on the base line of the wave configuration in spaced configuration to the wavelike cutting line. Each of these holes cooperates with the tube material bounded by the cyclic portion of the wave configuration associated with said hole to provide a handle for the finished shopping bag.

The bag formed by a technique of the type described above includes a handle portion of wave configuration shape that includes a strip of reinforcing plastic material. The strip extends across the handle portion in a direction generally parallel to the bottom edge of the bag, and said strip includes a lower boundary edge which intersects the wave configuration at locations between the lowest and highest points on the wave configuration, i.e., at points which are spaced inwardly of the side edges of the bag. The hole which forms a portion of the carrying handle may be so positioned that it is completely bounded by said material or, to effect a saving of plastic material, a somewhat narrower strip of material can be employed with the upper portion of the hole (where tearing is most likely to occur) being bounded by said strip while the lower portion of the hole extends into a thinner gauge portion of the carrying handle.

BRIEF DESCRIPTION OF THE DRAWINGS

The foregoing objects, advantages, and construction and operation of the present invention will become more readily apparent from the following description and accompanying drawings wherein.

DESCRIPTION OF THE PREFERRED EMBODIMENTS

FIGS. 1–4 illustrate a novel plastic shopping bag constructed in accordance with the present invention. The bag includes front and rear sides 1 and 2 formed of portions of a plastic film tubing, a bottom edge 3 which comprises a portion of the edge of the starting tube mold, and side seams 4 and 5 which are formed by an appropriate sealing and cutting technique to attach the front and rear sides 1 and 2 of the bag to one another and to sever the bag from the remainder of the plastic film tubing mold during the fabricating operation. The bottom of the bag can include an inwardly folded portion 6 (see FIG. 2) to facilitate expansion of the bag at its bottom edge when materials are later placed therein.

Figure 1:
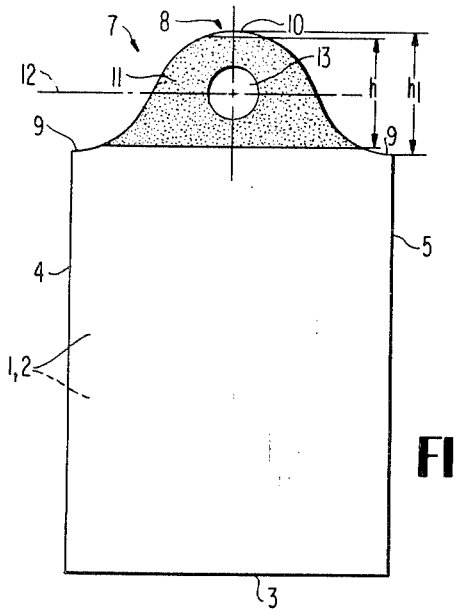
FIG. 1 is a side view of a plastic shopping bag constructed in accordance with the present invention.
Figure 2:
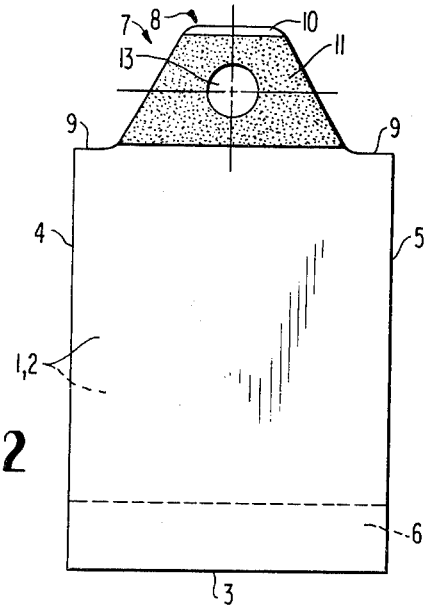
FIG. 2 shows another embodiment of the plastic shopping bag of the present invention having a handle portion of wave configuration different from that of FIG. 1.
Figure 3:
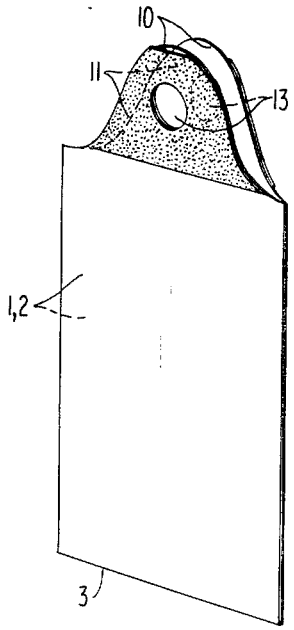
FIG. 3 is a perspective view of the bag shown in FIG. 1.
Figure 4:
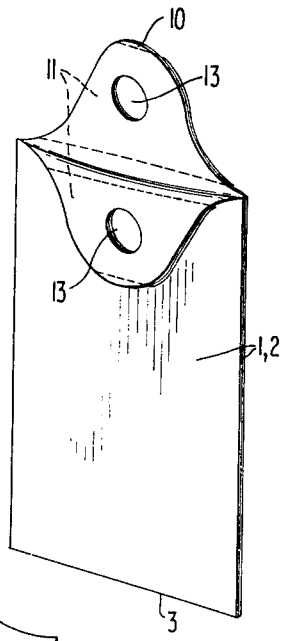
FIG. 4 is a view similar to FIG. 3 illustrating how one of the handle flaps can be folded downwardly.

The open mouth 7 of the bag includes a handle portion 10 comprising a pair of opposing flaps (see especially FIGS. 3 and 4) which are integral respectively with the front and rear sides 1 and 2 of the bag. Each of these flaps may be provided with a hole 13 to facilitate carrying of the bag and its placement on a rack for display purposes. Each flap has a wavelike configuration, e.g., one of sinusoidal shape (as shown in FIGS. 1, 3 and 4) or of other curve shape, or of any other desired wave like configuration such as the essentially flat sided and flat topped configuration shown in FIG. 2. In any of these cases, the shape is such that the highest point 8 of the curve is located on the center line of the bag substantially equidistant between the side seams 4, 5 thereof, the lowest points 9 of the wavelike configuration are located at the side edges 4, 5 of the bag, and the period of the wave form corresponds to the width of the bag at its open mouth.

The handle flaps 10 of the bag are each provided with a reinforcing band 11. Band 11 on each flap may comprise a portion of an elongated reinforcement strip which has a width h that is somewhat less than the amplitude $h_1$ of the wavelike mouth portion of the bag. Moreover this lesser width reinforcement strip is so disposed on each flap 10 that the lower boundary edge of the reinforcement strip intersects said wave configuration at locations between the lowest and highest points of the wave configuration so that no portion of the reinforcement material extends to the side seams 4, 5 of the bag.

The reinforcement sections 11 are, as will be described hereinafter, preferably glued onto the plastic film tubing during an initial stage of the bag processing operation. In the alternative, the reinforcement sections can be produced on each side of the plastic tubing that is used at the starting material in the bag fabricating technique, during the extrusion of said plastic tubing. In either event, the positioning of the reinforcing strips on the sides of the plastic tube, and its width h, are so selected that when the tubing is subsequently cut along a wavelike cutting line having a greater amplitude $h_1$, the crests of said wavelike cutting line (i.e., the points 8 and 9 shown in FIGS. 1 and 2) extend beyond the upper and lower boundary edges respectively of reinforcement section 11 into the thinner edge material of the plastic tubing itself, so that the transverse seams which define side edges 4, 5 of the bag are confined entirely to the thinner gauge portions of the plastic tubing and do not extend into the thicker gauge portion of the starting material defined by reinforcement strips 11. By reason of these considerations, the bags shown in FIGS. 1–4 are profitable to manufacture since they can be manufactured rapidly without the problems which would be encountered if seams had to extend through plastic materials of differing thicknesses. Moreover, manufacture of the new bags achieves a saving of raw materials over techniques suggested heretofore and, in addition, can be achieved more readily than prior techniques since the plastic tubing which is employed as a starting material is reelable onto rolls without difficulty, can be readily stored, and can be readily fed from storage to effect manufacture of the bag.

An additional advantage of the structure shown in FIGS. 1–4 is that, when the bag is suspended on a hanger by its handle flaps 10, one of the flaps can be readily folded downward as shown in FIG. 4. The fold line for said flap is displaced from the lower boundary edge of the reinforcement material 11 and is accordingly located in the thinner gauge portion of the bag material. This kind of flap folding can be effected as a step in the manufacturing process, to facilitate the automatic piling of manufactured bags during packing operations. The thickness increase of the handle flaps is easily compensated, for instance by folding the bottom part of the bag double during the piling process.

In the arrangements shown in FIGS. 1–4, the hole 13 is located entirely within the reinforcement strip 11. This is not mandatory, however, and, if desired, the hole 13 can be only partially bounded by a somewhat narrower reinforcement strip 11, e.g., hole 13 can be so located relative to the lower boundary edge of such a strip 11 that said lower boundary edge intersects the hole and reinforcement material bounds only an upper portion of the hole 13 where tearing is most likely to occur, while the lower portion of the hole is located in the thinner gauge bag material.

Figure 5:
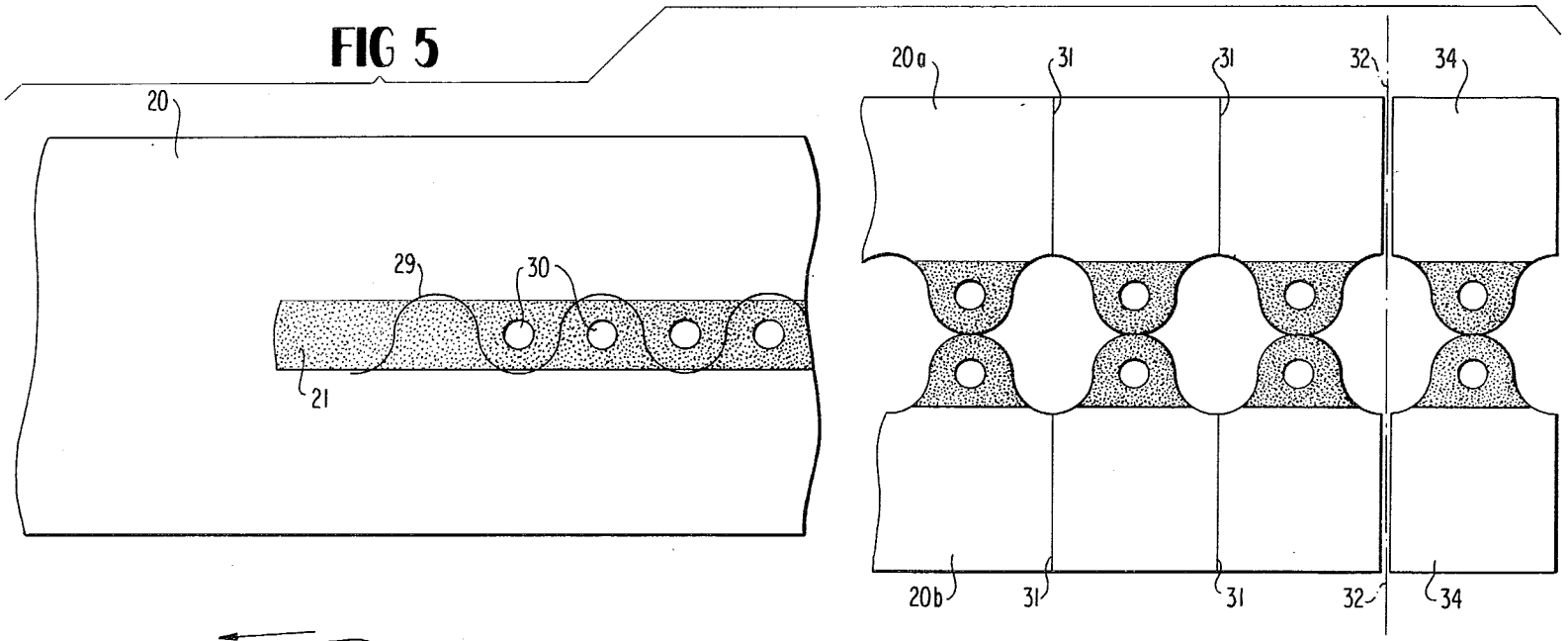
FIG. 5 illustrates a method of manufacturing bags of the types shown in FIGS. 1–4.
Figure 6:
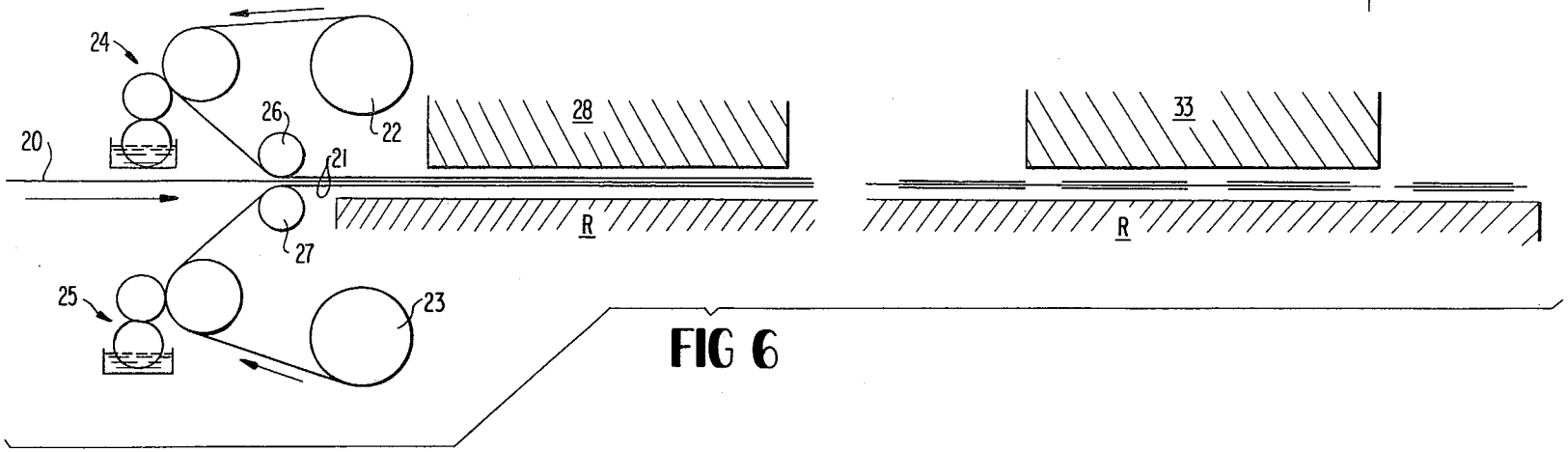
FIG. 6 is a diagrammatic illustration of an apparatus which can be employed to implement the method of FIG. 5.

FIGS. 5 and 6 illustrate a preferred method and apparatus for fabricating bags of the types shown in FIGS. 1–4. An elongated tube 20 of plastic film material is provided, said tube having a flattened configuration which defines a pair of elongated tube faces that are disposed closely adjacent to one another. Tube 20 is fed, either directly from a tube extruder or from a reel of such tubing, along a processing band R (see FIG. 6). During this feeding of tubing 20, a pair of reinforcing strips 21 are fed from reels 22 and 23 through glue applicators 24, 25, to pressure rolls 26, 27 which function to adhesively secure the two reinforcing strips 21 to opposite faces of tubing 20 in overlapping coextensive relation to one another.

In the next step of the process, a cutter 28 cuts through the adjacent tube faces along a cutting line 29 of cyclically recurring wave configuration that extends in the direction of elongation of the tube faces and along the coextensive overlapping strips 21 of reinforcing material. The wavelength of cutting line 29 is preselected to be substantially equal to the desired width of each shopping bag at the mouth of the shopping bag, and the amplitude of the cutting line 29 is greater than the widths of the reinforcement strips 21 whereby the crests of said wavelike cutting line extend beyond the boundary edges of reinforcing strips 21 into the thinner gauge material portions of the tube faces. During this cutting process, moreover, holes 30 (corresponding to the holes 13 shown in FIGS. 1–4) are punched or at least partially cut into the tube faces along the base line of wave configuration 29, with one such hole 30 being provided for each cycle of the wave configuration. If the holes 30 are only partially punched at this stage of the operation, the remainder of the hole cutting operation can be achieved later in the processing operation.

After the central portion of the tube has been cut along line 29 as described, the severed portions of the plastic tubing are preferably separated from one another in a direction transverse to the direction of elongation of the tube, and these severed portions are then longitudinally displaced relative to one another through a distance of half the wavelength of the wave configuration to produce the disposition which is depicted at the right side of FIG. 5. In this disposition, the two portions 20*a* and 20*b* of the starting tube are so shifted longitudinally and transversely relative to one another that the handle portions of two rows of bags are directly opposite one another; and in this configuration the plastic material may then be sealed along a plurality of lines 31 which are aligned with one another in the two sections 20*a*, 20*b*, and cut along aligned intersections 32, by means of seaming devices and cutters 33, to produce, for each such seaming and cutting operation, two parallel bags 34 each of which has the configuration already described in reference to FIG. 1. It should be noted especially that, due to the relationship between the width of the reinforcing strips 21 and the amplitude of the wavelike cutting line 29, each of the transverse sealing and cutting lines 31, 32 is disposed entirely in a region of constant thickness material, and does not include any section which extends into the thicker reinforced region of strip 21.

Figure 7:
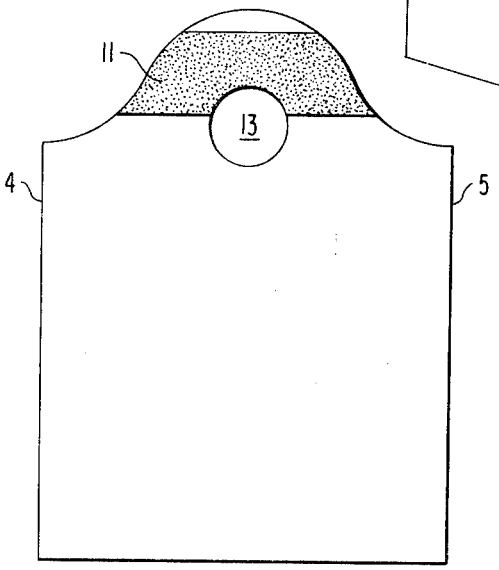
FIG. 7 shows another embodiment of the plastic shopping bag of the present invention.

In FIG. 7, a narrower reinforcement strip is shown, and hole 13 is so located relative to strip 11 that the lower boundary edge of the strip intersects the hole. It is also quite practical to provide a reinforcement strip even narrower than that shown in FIG. 7, but of course it is preferable to locate such narrow strip so that it lies above the hole 13 since, when a heavy load is carried in the bag, any tendency to tear will occur primarily in the portion above the hole 13. In any such embodiments, of course, the holes 13 for successive bags may be located inwardly (i.e., toward the bag's bottom) from the base line of the wavelike configuration defining the handle portion of the bag as shown in FIG. 7.

I claim:

1. The method of forming a plurality of plastic shopping bags comprising the steps of providing an elongated tube of plastic film material having a flattened configuration which defines a pair of elongated tube faces that are disposed closely adjacent to one another and each of which faces includes an elongated strip of plastic material that is of heavier gauge than the remainder of said faces, said strips of heavier gauge material being positioned in coextensive overlapping relation to one another in the direction of elongation of said tube at locations on said tube faces substantially equidistant from the edges of said tube faces, the width of each of said strips between said edges being substantially less than the width of its associated tube face, cutting through said adjacent tube faces along a cutting line which has a cyclically recurring wave configuration extending in the direction of elongation of said tube faces and along said coextensive overlapping strips of heavier gauge material, the wavelength of said wave configuration being substantially equal to the desired width of one of said shopping bags at the mouth of said shopping bag, the amplitude of said cutting line wave configuration being greater than the widths of said heavier gauge strips whereby spaced crests of said wave configuration cut through the film material of said tube faces at positions outside of said heavier gauge strips, seaming the tube faces at a plurality of locations which extend respectively between said spaced crests and the outer edges of said flattened tube of plastic film material to provide a plurality of transverse seam lines, and thereafter cutting said tube faces along said plurality of transverse seam lines.

2. The method of claim 1 including the step of punching a plurality of holes through said tube faces, one for each cycle of said wave configuration, in spaced relation to said cutting line, each of said holes being located on the base line of said wave configuration, each of said holes and the said tube material bounded by the cyclic portion of said wave configuration associated with said hole providing a handle for one of said plastic shopping bags.

3. The method of claim 1 wherein said wave configuration is of sinusoidal shape.

4. The method of claim 1 including the step of separating the portions of said tube of plastic material from one another in a direction transverse to the direction of elongation of said tube following said first cutting step, and longitudinally displacing said separated portions of said tube relative to one another through a distance of half the wavelength of said wave configuration prior to seaming and cutting said faces along said transverse seam lines.

5. The method of claim 1 including the step of adhesively securing a pair of elongated strips of plastic material to the outer faces of said flattened tube of plastic material to form said heavier gauge plastic portions on said tube faces prior to said first cutting step.

* * * * *